US005718848A

United States Patent [19]

James

[11] Patent Number: 5,718,848

[45] Date of Patent: Feb. 17, 1998

[54] INTENSIFICATION OF EVAPORATION AND HEAT TRANSFER

[75] Inventor: Robert Wilton James, Adelaide, Australia

[73] Assignee: F F Seeley Nominees Pty Ltd, St Marys, Australia

[21] Appl. No.: 624,598

[22] PCT Filed: Aug. 18, 1995

[86] PCT No.: PCT/AU95/00515

§ 371 Date: Apr. 18, 1996

§ 102(e) Date: Apr. 18, 1996

[87] PCT Pub. No.: WO96/06312

PCT Pub. Date: Feb. 29, 1996

[30] Foreign Application Priority Data

Aug. 18, 1994 [AU] Australia ..... PM 7550

[51] Int. Cl.[6] ..... B01F 3/04

[52] U.S. Cl. ..... 261/128; 261/104; 261/153

[58] Field of Search ..... 261/104, 153, 261/128, 147

[56] References Cited

U.S. PATENT DOCUMENTS

| | | | |
|---|---|---|---|
| 847,840 | 3/1907 | Smith | 261/104 |
| 1,367,701 | 2/1921 | Haynes | 261/104 |
| 1,769,071 | 7/1930 | Raney | 261/104 |
| 1,853,419 | 4/1932 | Harris | 261/153 |
| 1,945,464 | 1/1934 | Thomas | 261/104 |
| 2,565,221 | 8/1951 | Gaugler | 261/104 |
| 4,002,040 | 1/1977 | Munters | 261/153 |
| 4,461,733 | 7/1984 | Otterbein | 261/153 |
| 4,708,832 | 11/1987 | Norback | 261/153 |
| 4,977,753 | 12/1990 | Maisotsenko et al. . | |
| 5,079,934 | 1/1992 | Vinokurov . | |
| 5,187,946 | 2/1993 | Rotenberg et al. . | |
| 5,301,518 | 4/1994 | Morozov et al. . | |
| 5,315,843 | 5/1994 | Morozov et al. . | |
| 5,324,230 | 6/1994 | Hist . | |

FOREIGN PATENT DOCUMENTS

| | | | |
|---|---|---|---|
| 28113/89 | 3/1990 | Australia . | |
| 655348 | 12/1994 | Australia . | |
| 81769/94 | 12/1994 | Australia . | |
| 2459437 | 2/1981 | France | 261/153 |
| 2546614 | 5/1983 | France . | |
| 384666 | 12/1932 | United Kingdom | 261/104 |
| 1504385 | 9/1993 | United Kingdom . | |

OTHER PUBLICATIONS

"Engineering Thermodynamics Work and Heat Transfer", p. 488, Rogers and Mayhew (1957).

*Primary Examiner*—Tim R. Miles

*Attorney, Agent, or Firm*—Watts, Hoffmann, Fisher & Heinke Co., L.P.A.

[57] ABSTRACT

An evaporative air cooler evaporates water in multistages by passing air across a series of spaced parallel wetted wicks (11) which repeatedly interrupt air flow. This enhances both evaporation and heat transfer rates. Wetting of the wicks (11) is achieved at their ends (22), and the wicks are either sloping or horizontal, not vertical, so that passage of water along the wicks is not impeded by gravity

10 Claims, 5 Drawing Sheets

INTENSIFICATION OF EVAPORATION AND HEAT TRANSFER

This invention applies both to evaporation and heat transfer across a heat exchanger surface occurring in a heat exchanger wherein there is an air flow with low Reynolds number and hence the air flow tends to be laminar, and the invention also relates to a humidifier, a heat exchanger and a method of evaporation of water into an air stream in an evaporative cooler, and a method of heat transfer in a heat exchanger.

BACKGROUND OF THE INVENTION

In prior art the transfers of mass and energy are intended to occur continuously along extended surfaces, for example long air passages in a heat exchanger. However, a characteristic of heat exchange across a surface is that the thickness of a boundary layer of gas constitutes an obstruction to transfer of mass or energy, but prior art heat exchangers have frequently used long passages defined by walls of constant cross-sectional shape, for example, tubes, and frequently operate under low Reynolds numbers wherein the boundary layer can develop very significant thickness, requiring the heat transfer to take place through a thickness of air or other gases or vapours, but such air or other gases or vapours are very resistant to heat transfer. Consequently, use has been made of excessive heat exchanger areas for transferring of heat, for example from a wet channel to a dry channel, and very small cross-sectional area tubes have been used in large numbers to create a heat exchanger having a very large area of heat exchange surface to obtain a low temperature output of air cooled below its wet bulb temperature. It is known that the necessity to use a lot of the excess of material was due to the requirement for mass and heat transfer to take place not only through thin solid boundary walls of an air passage but also through laminar layers of gas within that passage, and water in an adjoining passage.

Reference may be made to Page 488 of the text book entitled, "Engineering Thermodynamics Work and Heat Transfer," Rogers and Mayhew (1957), wherein the following statement may be found:

> "... once the flow is fully established (in a tube), the fluid can have no velocity components normal to the wall anywhere in the cross-section, otherwise successive velocity profiles would not be identical. There is no divergence of the streamlines away from the wall ... , and the heat flow in the radial direction must therefore be entirely by conduction."

Gases are notorious insulators against conduction.

It has been established that the use of water passing through an absorbent pad in one direction and cooling by evaporation air passing through the pad in cross flow is only cable of achieving air cooling down to temperatures approaching the wet bulb temperature. Wicks are old and well known in the art of evaporative air conditioning, and it has been found that by using wicks (which can be vertical, lateral or preferably sloping) it is possible to construct a device cable of getting below the initial wet bulb temperature and towards the dew point for the relevant temperature.

The main objects of this invention are to provide an improved evaporation of water into an air stream, and to provide a heat exchanger having a higher heat and mass transfer than prior art otherwise known to the Applicant, and a further object is to provide an efficient cooler using evaporation of water.

This invention utilises air passages wherein laminar flow is interrupted by wet wicks sufficiently so that even under the very low Reynolds number conditions, sufficient turbulence is developed to effect periodic restart of the process of evaporation of moisture from the wicks. It should be noted that the process of evaporation is closely allied to the process of heat transfer, both processes involving a somewhat similar molecular movement within a passage.

Consistent with the above recited relationship between flow of air and heat flow in a direction at right angles thereto, further study conducted by the Applicants of the behaviour of evaporation as air passes over a moist surface has indicated that the main evaporation and therefore the main cooling occurs at the upstream end of an elongate wet air passage, and that the rate of energy and mass transfer tapers off as the air continues to traverse over the wet surface. Evaporation is also intensified (although to a lesser extent) at the trailing edge of a wet surface. Theoretical studies have further confirmed that this phenomenon is due to the thickening of the boundary layer of air as it passes over an inner surface of a tube, wherein its displacement thickness causes centre line velocity to accelerate until a fully developed velocity profile is reached. This defines an entry transition profile.

High wall shear stress is what allows mass and energy transfer to occur. The Reynolds analogy is valid since the mechanisms of evaporation (mass transfer) and energy transfer both rely on similar molecular movement within the boundary layer.

The rate of mass transfer during the passage of air over a moist wall of constant cross-sectional shape depends on the local value of the mass transfer coefficient, which progressively reduces from the entry zone in a downstream direction towards a fixed, fully developed value. This affects the slope of the humidity vs distance curve, and the concentration gradient will reduce with respect to the distance travelled, as the flow humidifies. Graphs which are FIGS. 6 and 7 compare distance travelled by air from its entry zone and humidity, with large and small diameter tubes with constant cross-sectional shape, and corresponding temperature changes.

BRIEF SUMMARY OF THE INVENTION

In an embodiment of the invention cooling is effected in multi-stages, passing air over a series of spaced wet evaporating pads or wicks and interrupting air flow by said wet pads thereby providing a periodic restart of evaporation. Further in the invention, the improved cooling associated with improved evaporation is also associated with a heat exchanger, wherein the same interruption imparts an improved transfer of sensible heat. Optimum evaporation conditions can be achieved, and heat transfer conditions can also be greatly enhanced. In some embodiments of the invention heat transfer will take place through a very thin wall of impervious material (for example plastics), which divides wet and dry parts of the heat exchanger.

Optimum distance between the wet pads needs to be determined in conjunction with the number of variables including additional flow resistance induced by the disruptions, and this may vary with the objectives of the application. For example, if the objective is a very compact evaporator or heat exchanger, flow disruption may be very frequent for high mass/energy transfer rates at the penalty of high flow resistance. An application objective of low operating cost may extend the distance between the disruptions to achieve good transfer at lower flow resistance.

It has been found that for applications involving successive evaporation and heat transfer, there is frequently an optimum ratio of wet pad widths to distances between them along the flow, one port wet pads to two ports between them, and three ports between them respectively for optimum evaporation and optimum heat transfer.

BRIEF DESCRIPTION OF THE PREFERRED EMBODIMENTS

Embodiments of this invention are described hereunder in some detail with reference to and are illustrated in the accompanying drawings in which.

Figure 3A:
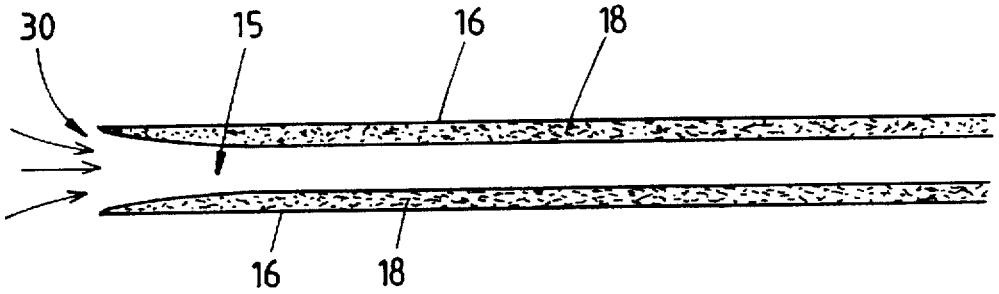
Figure 3B:
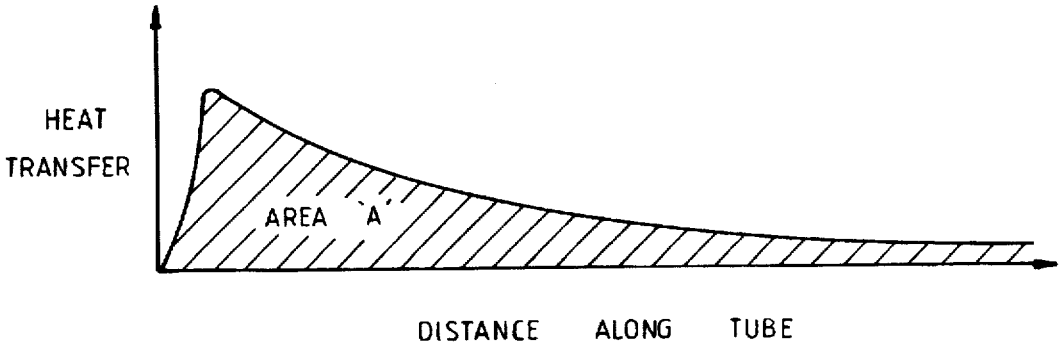
Figure 4A:
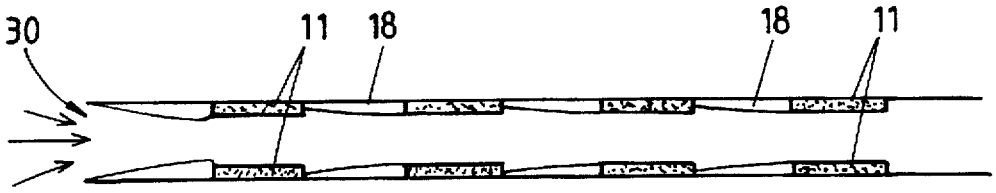
Figure 4B:
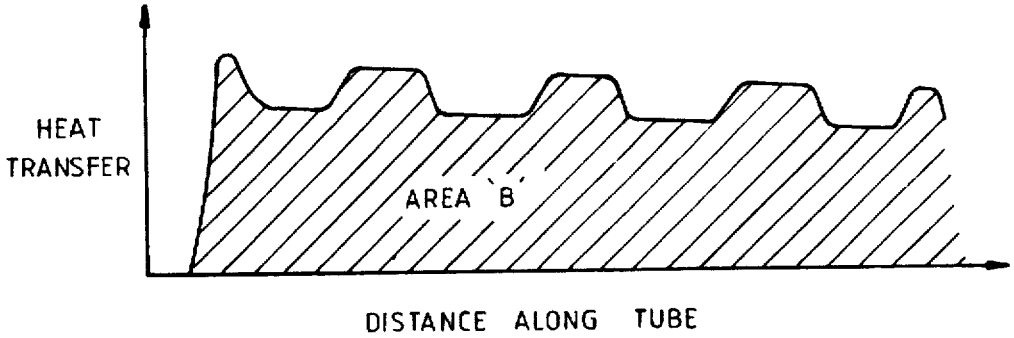

FIG. 3*a* is a diagrammatic representation of two surfaces defining an air flow passage spaced from one another, and indicating how a boundary layer will build up to retain its shape after initial entry of the air into the passage has been completed;

FIG. 3*b* is a graph which shows an expectation of heat transfer vs distance along the air flow passage of FIG. 3*a*, and an area marked "area A";

FIG. 4*a* shows the effect of interrupting the boundary layer, in this example by a series of wet wicks which are spaced adjacent one another on opposite sides of the boundaries of an air flow passage;

FIG. 4*b* shows diagrammatically the heat transfer vs distance along the tube of air flow in the arrangement of FIG. 4*a;*

Figure 5:
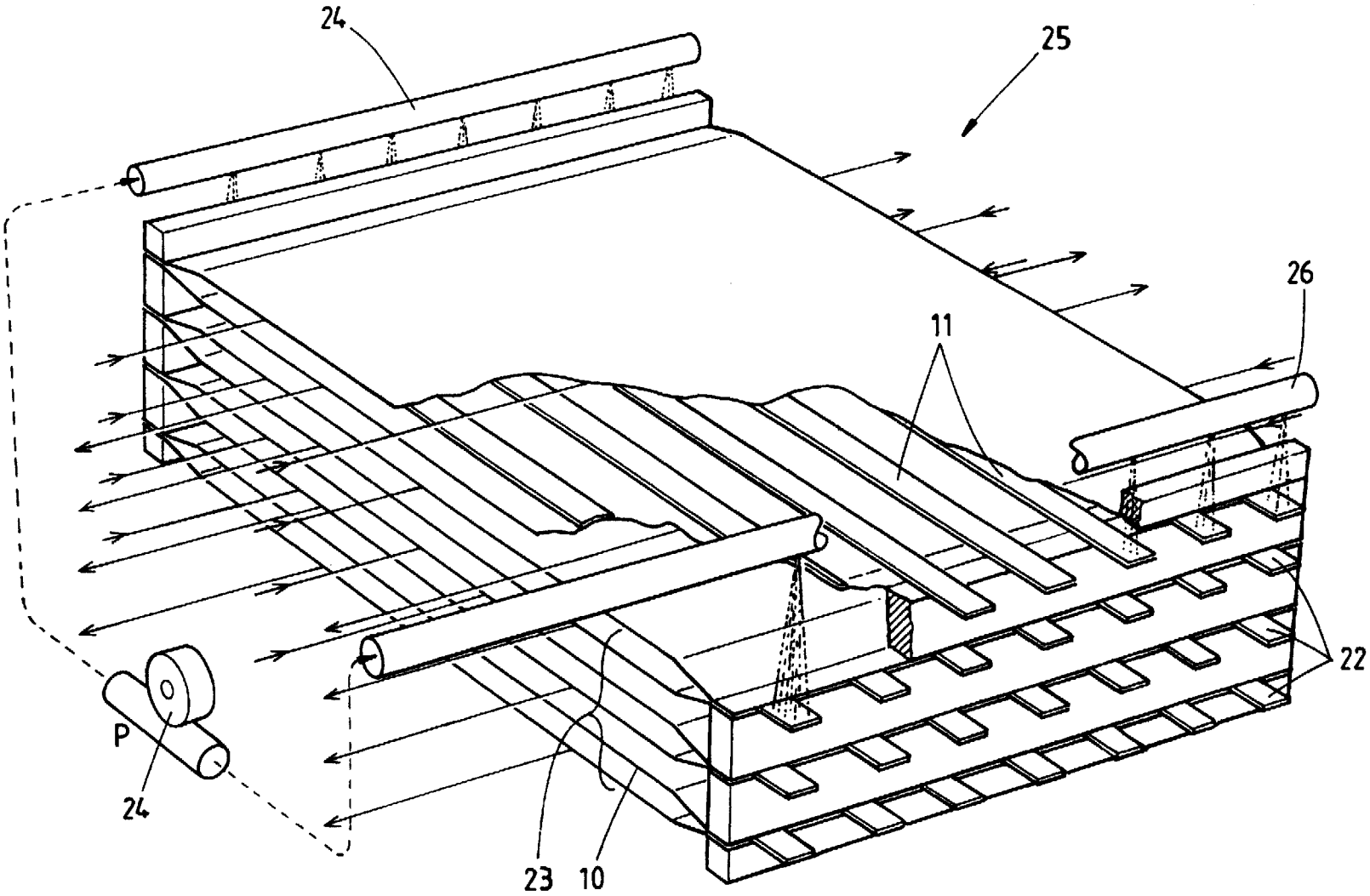

FIG. 5 shows a contra-flow heat exchanger with spaced wet wicks.

Figure 6:
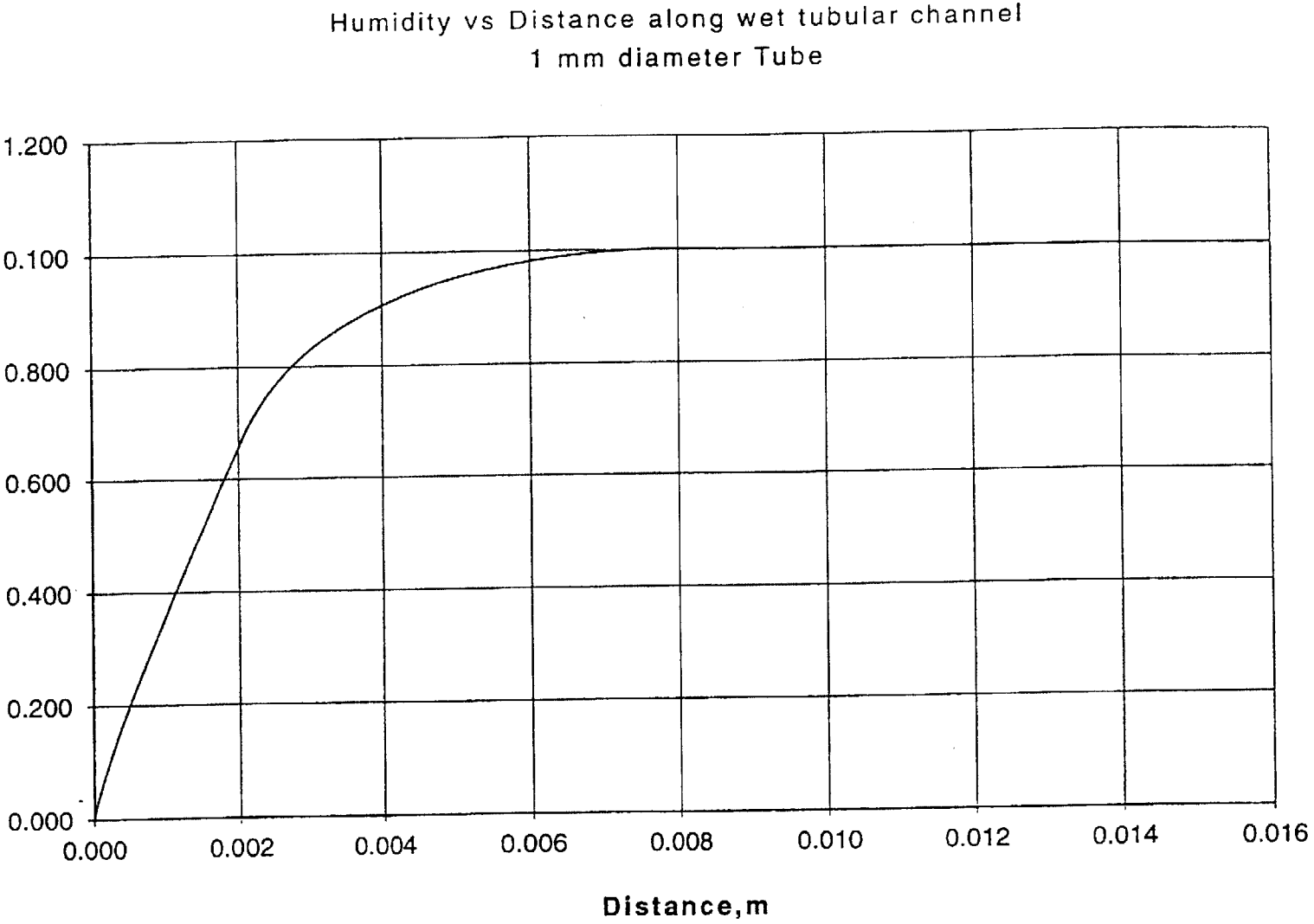
Figure 7:
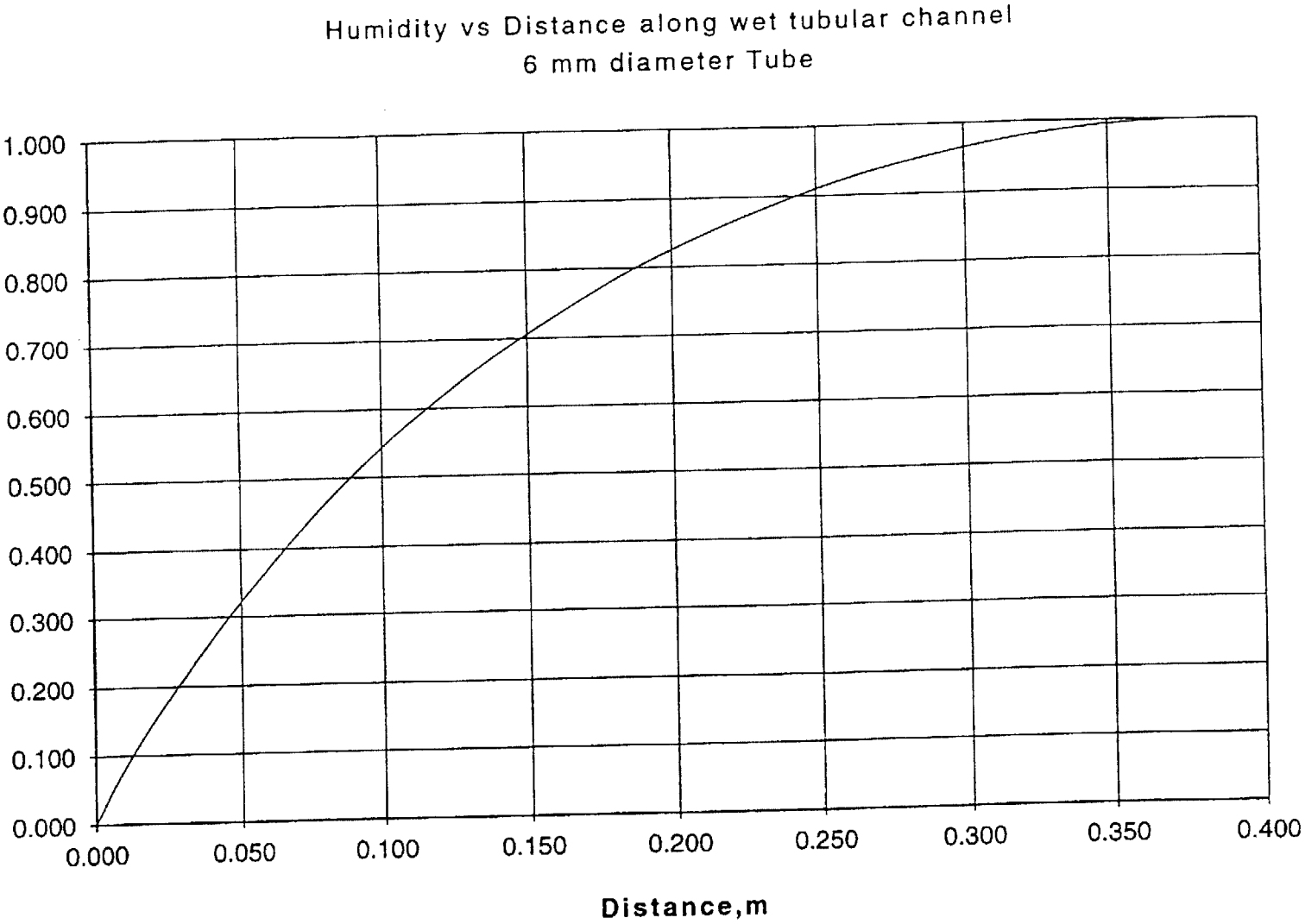

FIG. 6 is a graph illustrating rapid asympote of evaporation in a small tube; and, FIG. 7 is a graph showing that evaporation continues beyond a 350 millimeter distance from the entry point in a tube which is 6 millimeters in diameter.

Figure 1:
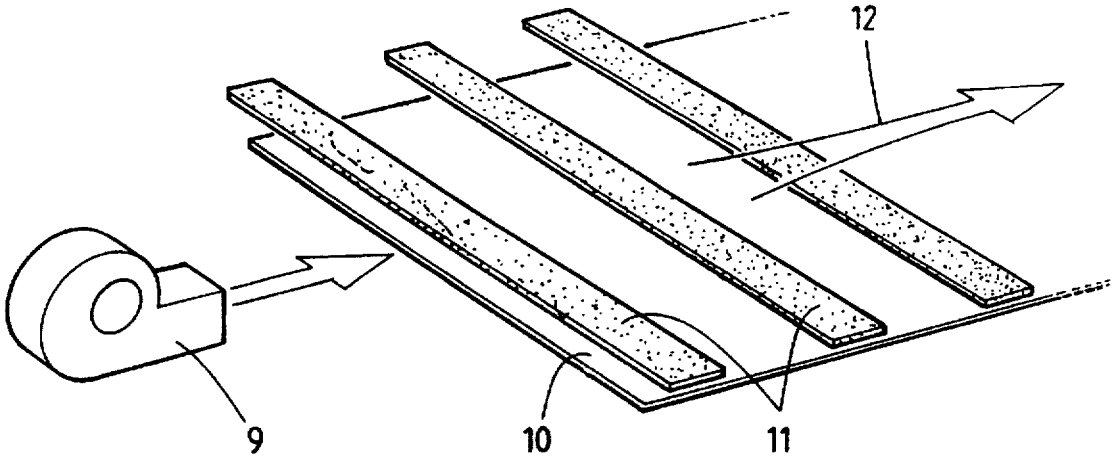
FIG. 1 is an illustration of a humidifier with a series of discrete wetted wicks adhered to a surface of a thin wall substrate which may not necessarily be porous.

FIGS. 1 through to 4*b* are indicative of how the principles of this invention can be incorporated, but it will be clear that other configurations can be used.

Figure 2:
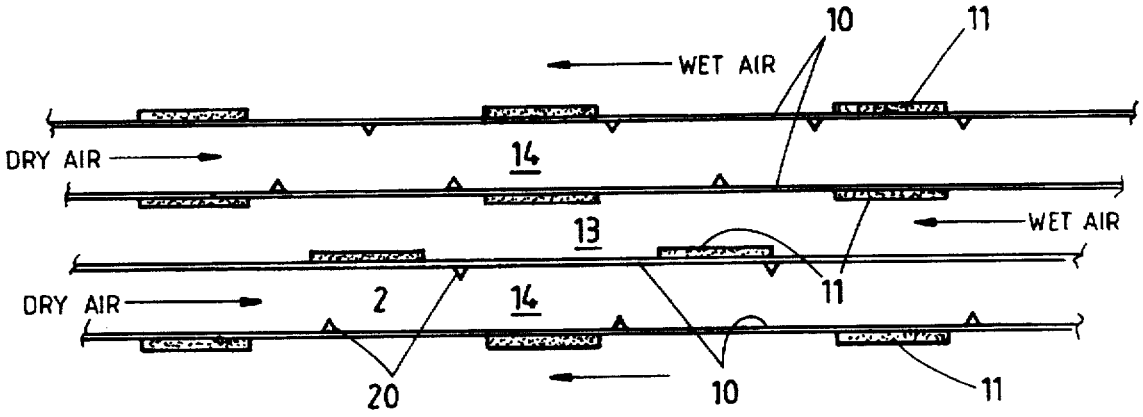
FIG. 2 shows a sectional end elevation of FIG. 1 drawn to a larger scale and illustrating the manner in which air will pass over wet wicks, FIG. 2, however, showing several layers of a heat exchanger complex.

In the embodiment illustrated in FIGS. 1 and 2, a substrate 10 comprising a panel of thin plastics material (for example, thin wall dense polyethylene film) has adhered to it face-to-face a plurality of spaced porous wettable wicks 11 and these perform the function of repeatedly interrupting the boundary layer flow of air, which would otherwise be consistent over the substrate 10. As it encounters the wettable wicks 11, the air is caused to become turbulent thereby disturbing the boundary layer, and as it encounters the next strip downstream, it is more rapidly cooled by the mass transfer than it would have been if it passed over a continuous wide pad. A fan 9 is shown in FIG. 1 diagrammatically to illustrate source of air flow.

The total amount of heat which can be transferred is compared in FIGS. 3*a*, 3*b* and 4*a*, 4*b*. In FIGS. 3*a*, 3*b* the amount of heat being transferred is asymptotic along side a minimum heat transfer level, as the air flow progresses downstream from an entry, in a passage 15 between two impervious solid films 16, and in FIG. 3*b*, the "area A" is an integral of the heat transfer along the tube, such that the area A is representative of the total heat transfer.

Drawn to the same scale in FIGS. 4*a* and 4*b*, the wicks 11 are shown to repeatedly interrupt the boundary flow which is designated 18 so that maximum evaporation can occur over the wicks, particularly at their leading and trailing edges, and FIG. 4*b* shows how there is a repeated restart of evaporation. The area B will be seen to be much larger than the area A, and therefore indicates a much greater degree of heat transfer, or in other words, for the same amount of heat transfer, a much smaller and more economical heat exchanger.

FIG. 6 illustrates the very rapid asymptote of evaporation in a small 1 mm diameter tube or spacing between parallel surfaces, no noticeable evaporation taking place after air traverses 8 mm from its entry point. FIG. 7 shows, by contrast, that evaporation continues beyond a 350 mm distance from the entry point in a tube which is 6 mm in diameter. The cooling effect by heat transfer through the substrate 10 is similarly more effective if substrates of a stack are more widely spaced, for example up to 6 mm.

These effects are utilised to advantage in the humidifier of FIG. 1 (for direct evaporative cooling), and the heat exchangers of FIGS. 2 and 5 (for indirect evaporative cooling). In indirect evaporative cooling, the secondary advantage of enhancing heat transfer is of special importance.

In FIG. 1, the warm dry ambient air flow is converted by the periodically restarted evaporation from wet strips into a moist cool air flow 12, and an array of substrates each with wettable strips 11 can provide an excellent cooling pad for a simple evaporative cooler.

However there is also advantage in disturbing the dry air flow in a heat exchanger, and as shown in FIG. 2 there is a wet air passage 13 separating two dry air passages 14 by the substrate films 10. The wet wicks 11 disturb the boundary layer and cause some turbulence in the wet passages 13, while projections 20 will have a somewhat different effect in dry passages 14, but nevertheless, will enhance the heat transfer.

The illustrations of FIGS. 1 and 2 show a layout of wetted strips which improve evaporative efficiency, and for example an evaporative cooler can be of simplified construction if the spaced wetted wicks replace the conventional woodwool.

However, the invention also extends to a heat exchanger 25, shown in FIG. 5. The FIG. 5 embodiment also uses a plurality of wicks 11 spaced apart on film substrates 10, and for wetting purposes, ends 22 of wicks 11 project outwardly beyond the ends of a stack 23 of substrates, and a pump 24 cascades water over the projecting wick ends 22, via a pair of perforate spreader tubes 26. The wicks 11 are horizontal, or sloping, not vertical as in prior art, and this enhances transport of water along the wicks.

A consideration of the above embodiment will immediately indicate to the reader that the invention is exceedingly simple but can be put into practice in many ways. For example, the wicks 11 are not always necessarily adhered to but can be otherwise carried by the substrates 10, for example clamped at spaced intervals, and if the mass transfer is taken to a maximum efficiency, the heat transfer will also be made more efficient.

I claim:

1. A heat exchanger for evaporating water in a stream of air through a wet air passage, at least three spaced parallel sheets defining between them said wet air passage and a dry air passage, a plurality of wettable wicks attached in face to face contact with a said sheet, in a spaced parallel array in said wet air passage, and extending in a direction generally normal to a stream of air therethrough when the exchanger is in use, and at least one fan to establish such stream of air in said wet air passage and a further stream of air through said dry air passage in a heat exchange relationship with the first such stream.

2. A heat exchanger according to claim 1 comprising a further plurality of parallel sheets defining a stack of alternate said wet and dry air passages.

3. A heat exchanger according to claim 1 wherein ends of said wettable wicks project outwardly from between said sheets of said wet passage, and further comprising a water application means positioned to wet said projecting wick ends.

4. A heat exchanger according to claim 1 wherein said wet and dry streams of air flow in opposite directions.

5. A heat exchanger according to claim 1 wherein said sheets defining said dry air passage comprise projections entering said dry air passage sufficiently to cause some turbulence of said further stream of air.

6. A heat exchanger according to claim 1 wherein said sheets and said wicks are non-vertical.

7. A heat exchanger according to claim 1 wherein said sheets and said wicks are generally horizontal.

8. A method of humidifying air in a heat exchanger which is in accordance with claim 1, comprising wetting each of the plurality of spaced parallel wicks located between a pair of sheets which define the wet air flow passage, and impelling a stream of air through said wet air flow passage to be repeatedly interrupted by said wetted wicks.

9. A method of cooling air in an evaporative cooler comprising wetting each of a plurality of spaced parallel wicks located between two sheets which define a wet air flow passage, impelling a first stream of air through said wet flow passage in one direction to be repeatedly interrupted by successive said wetted wicks and humidified thereby, and impelling a second stream of air through a dry air passage defined by a said sheet and a third sheet spaced therefrom to thereby effect sensible heat exchange between said air streams.

10. A method according to claim 9 further comprising effecting said sensible heat exchange by impelling said second stream of air over a surface of a said sheet, the opposite surface of which has said parallel wicks adhered thereto in a face-to-face relationship.

* * * * *